US010307764B2

(12) United States Patent
Petack et al.

(10) Patent No.: US 10,307,764 B2
(45) Date of Patent: Jun. 4, 2019

(54) MACHINERY FRAME FOR A ROLLER CRUSHER

(71) Applicant: TAKRAF GmbH, Leipzig (DE)

(72) Inventors: Burkhard Petack, Senftenberg (DE); Marko Schmidt, Stauchitz OT Treben (DE); Karsten Ebenhan, Dresden (DE); Patrick Neufeldt, Finsterwalde (DE)

(73) Assignee: TAKRAF GmbH, Leipzig (DE)

( * ) Notice: Subject to any disclaimer, the term of this patent is extended or adjusted under 35 U.S.C. 154(b) by 0 days.

(21) Appl. No.: 15/161,225

(22) Filed: May 21, 2016

(65) Prior Publication Data

US 2016/0339441 A1 Nov. 24, 2016

(30) Foreign Application Priority Data

May 21, 2015 (DE) ..... 10 2015 209 280

(51) Int. Cl.
*B02C 4/00* (2006.01)
*B02C 4/02* (2006.01)
(Continued)

(52) U.S. Cl.
CPC ..... *B02C 4/02* (2013.01); *B02C 4/28* (2013.01); *B02C 4/30* (2013.01); *B30B 15/04* (2013.01)

(58) Field of Classification Search
CPC .... B02C 4/02; B02C 4/28; B02C 4/30; B02C 4/08; B30B 15/04
(Continued)

(56) References Cited

U.S. PATENT DOCUMENTS 344,258 A * 6/1886 Dunne ..... B30B 3/04 241/230
1,743,911 A * 1/1930 Borton ..... B02C 4/28 241/285.2
(Continued)

FOREIGN PATENT DOCUMENTS

DE 29919968 U1 2/2000
DE 102007040046 A1 2/2009
(Continued)

OTHER PUBLICATIONS

European Search Report issued in the European counterpart application EP 16 16 9518.4-1712 (dated Oct. 4, 2016).
(Continued)

*Primary Examiner* — Faye Francis
(74) *Attorney, Agent, or Firm* — FisherBroyles, LLP; Andrew K. Gonsalves, Esq.

(57) ABSTRACT

The present invention relates to a machine frame for a roll crusher that has two side walls and two end walls, where the mentioned end walls accommodate the storage of the rolls. The end walls are split horizontally in the area of the mounting of the rollers, and vertically between the mountings of the upper part. One advantage is that to remove a roller, removal of the respective upper end wall is sufficient. In a preferred embodiment of the invention, the adjacent upper parts of the end walls do not touch. An advantage of this is that tilting of the end wall upper parts among each other or in contact with the side walls is prevented during removal. Furthermore, the gap resulting from the distance between the front wall upper parts in the preferred embodiment would be sealed, with the advantage that no material and dust can exit.

7 Claims, 2 Drawing Sheets

(51) Int. Cl.
*B02C 4/30* (2006.01)
*B02C 4/28* (2006.01)
*B30B 15/04* (2006.01)

(58) Field of Classification Search
USPC ..... 241/285.2
See application file for complete search history.

(56) References Cited

U.S. PATENT DOCUMENTS 3,578,252 A * 5/1971 Brewer ..... B02C 18/142 241/141
3,881,663 A * 5/1975 Brown ..... B02C 4/38 222/410
4,082,232 A * 4/1978 Brewer ..... B02C 13/2804 241/236
4,101,083 A * 7/1978 Faist ..... B02C 4/28 241/159
5,244,158 A * 9/1993 Popovich ..... B02C 13/282 228/135
5,328,107 A * 7/1994 Tsai ..... B02C 18/0007 241/236
5,395,057 A * 3/1995 Williams, Jr. ..... B02C 18/142 241/236
6,092,753 A * 7/2000 Koenig ..... B02C 18/142 241/236
6,149,085 A * 11/2000 Fetzer ..... B02C 4/28 241/227
6,772,971 B1 8/2004 Becker et al.
7,234,656 B1 * 6/2007 Lo ..... B02C 18/0007 241/236
8,795,563 B2 * 8/2014 Splinter ..... B02C 4/32 100/170
8,967,507 B2 * 3/2015 Pusheck ..... B02C 4/08 241/231
9,289,959 B2 * 3/2016 Frangenberg ..... B02C 4/02
2008/0017052 A1 * 1/2008 Splinter ..... B02C 4/28 100/155 R
2011/0272515 A1 11/2011 Bohlefeld et al.
2013/0025476 A1 1/2013 Frangenberg
2014/0263777 A1 9/2014 Anderson, Jr.

FOREIGN PATENT DOCUMENTS

EP 1374999 A2 1/2004
WO 2010/032037 A1 3/2010

OTHER PUBLICATIONS

Eurasian Search Report issued in the Eurasian counterpart application EA 2016 00 329 (dated Oct. 21, 2016).
Australian Examination Report issued in the Australian counterpart application AU 2016203280 (dated Dec. 9, 2016).

* cited by examiner

MACHINERY FRAME FOR A ROLLER CRUSHER

CROSS-REFERENCE TO RELATED APPLICATIONS

This application claims priority benefit under 35 U.S.C. § 119 of German Patent Application No. 10 2015 209 280.1, filed May 21, 2015, the entire contents of which are incorporated herein by reference.

FIELD OF THE INVENTION

The present invention relates to a machinery frame for a roller crusher and the roller crusher itself.

BACKGROUND OF THE INVENTION

Roller crushers are used in the mining industry, for example. The material to be reduced in size is laid into the crack between two counter-rotating crushing rolls and crushed by crushing tools on the rolls.

The crushing rolls are mounted in machinery frame. The very high crushing forces that arise during operation are absorbed by this machinery frame. To facilitate maintenance work on the crushing rolls, the crushing rolls should be easily removable from the machinery frame.

It is known that the respective end wall of the machinery frame should be subdivided horizontally in the area of the mountings of the rollers, whereby the upper part (the upper part of the end wall) is removable and thus releases the mountings of the rollers in order to be easily able to remove these together with the mountings. A disadvantage is that here, the end wall upper part is frequently tilted and thus is only removable with difficulty. One possibility is to loosen the side walls, thus creating more space for removing the end wall. However, a disadvantage of this is that during assembly, a multitude of contact surfaces must be cleaned so that the frame can be connected without any play. Furthermore, there is a disadvantage that if there is the need to remove only one roller, elements of the other roller must in principle also be disassembled.

In WO 2010/032037 A1, it is proposed to divide the framework vertically between the crushing rolls. Here, a disadvantage is that to remove the roll, half of the framework has to be moved far enough that the roller can be removed.

The present invention is directed to addressing these and other deficiencies in the art.

SUMMARY OF THE INVENTION

The present invention relates to, inter alia, a machine frame for a roll crusher and the roll crusher itself. In certain embodiments, the machine frame has two side walls and two end walls, where the mentioned end walls accommodate the storage of the rolls. The end walls are split horizontally in the area of the mounting of the rollers, and vertically between the mountings of the upper part. One advantage is that to remove a roller, removal of the respective upper end wall is sufficient. In a preferred embodiment of the invention, the adjacent upper parts of the end walls do not touch. An advantage of this is that tilting of the end wall upper parts among each other or in contact with the side walls is prevented during removal. Furthermore, the gap resulting from the distance between the front wall upper parts in the preferred embodiment would be sealed, with the advantage that no material and dust can exit.

As set forth herein, numerals associated with various aspects of the present invention are as described in Table 1 herein.

In one aspect, the present invention provides a machinery frame for a roll crusher comprising two side walls (1) and two end walls (2) taking up the bearing (21) of the rollers, wherein the end walls are divided in the area of the mounting of the rolls horizontal (23) and between the bearings vertically (24), so that in the area of the mounting of the rolls cowl top parts (25) are releasable.

In one embodiment, the present invention provides a machinery frame for a roller crusher according to the present invention, wherein the cowl upper parts (25) of adjacent bearings do not touch when installed.

In one embodiment, the present invention provides a machinery frame for a roller crusher according to the present invention, wherein the vertical separation (24) between the two end wall upper parts (25) is sealed to the outside.

In one embodiment, the present invention provides a machinery frame for a roller crusher according to the present invention, wherein the cowl top parts (25) of adjacent bearings in the installed state are connected by at least one connecting element (3).

In one embodiment, the present invention provides a machinery frame for a roller crusher according to the present invention, wherein the connecting element (3) is a planar structure, which on the end wall to be connected to upper parts (25) rests and is screwed to this part.

In one embodiment, the present invention provides a machinery frame for a roller crusher according to the present invention, wherein the cowl top portion (25) in the installed state with the adjoining side wall (1) and end wall dividing (20) are connected to it.

In one embodiment, the present invention provides a machinery frame for a roller crusher according to the present invention, wherein the connection between the side wall lower part (20) and end wall upper portion (25) and/or the connection between the end wall of the upper part (25) and side wall (1) is by a screw connection.

In another aspect, the present invention provides a roll crusher comprising a machinery frame, wherein said machinery frame comprises two side walls (1) and two end walls (2) taking up the bearing (21) of the rollers, wherein the end walls are divided in the area of the mounting of the rolls horizontal (23) and between the bearings vertically (24), so that in the area of the mounting of the rolls cowl top parts (25) are releasable.

In one embodiment, the present invention provides a roll crusher comprising a machinery frame of the present invention, wherein the cowl upper parts (25) of adjacent bearings do not touch when installed.

In one embodiment, the present invention provides a roll crusher comprising a machinery frame of the present invention, wherein the vertical separation (24) between the two end wall upper parts (25) is sealed to the outside.

In one embodiment, the present invention provides a roll crusher comprising a machinery frame of the present invention, wherein the cowl top parts (25) of adjacent bearings in the installed state are connected by at least one connecting element (3).

In one embodiment, the present invention provides a roll crusher comprising a machinery frame of the present invention, wherein the connecting element (3) is a planar structure, which on the end wall to be connected to upper parts (25) rests and is screwed to this part.

In one embodiment, the present invention provides a roll crusher comprising a machinery frame of the present invention, wherein the cowl top portion (25) in the installed state with the adjoining side wall (1) and end wall dividing (20) are connected to it.

In one embodiment, the present invention provides a roll crusher comprising a machinery frame of the present invention, wherein the connection between the side wall lower part (20) and end wall upper portion (25) and/or the connection between the end wall of the upper part (25) and side wall (1) is by a screw connection.

These and other objects, features, and advantages of this invention will become apparent from the following detailed description of the various aspects of the invention taken in conjunction with the accompanying drawings.

BRIEF DESCRIPTION OF THE DRAWINGS

For the purpose of illustrating aspects of the present invention, there are depicted in the drawings certain embodiments of the invention. However, the invention is not limited to the precise arrangements and instrumentalities of the embodiments depicted in the drawings. Further, if provided, like reference numerals contained in the drawings are meant to identify similar or identical elements.

DETAILED DESCRIPTION OF THE INVENTION

Figure 1:
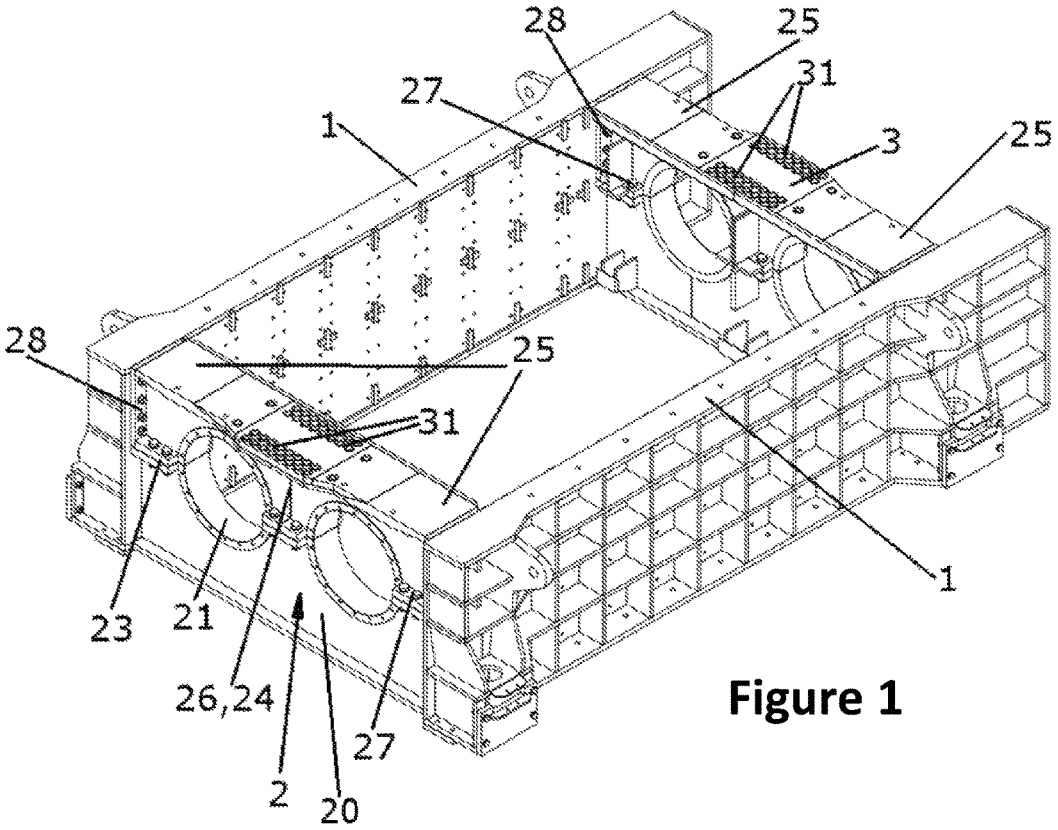
FIG. 1 is an illustration of an embodiment of one machinery frame of the present invention for a roll crusher in the closed state.

The present invention is directed to, inter alia, solving the noted deficiencies in the art by providing a framework for a roller crusher which has a simple design and allows for easy removal of the rolls.

According to one aspect of the present invention, this objective is achieved by a frame for a roller crusher as set forth herein and by the roller crusher, also as described herein. Preferred embodiments of this invention are described herein and in the claims.

In certain embodiments, this machinery frame according to the invention for a roller crusher has two side walls and two end walls, whereby the end walls accommodate the mounting of the rolls. The end walls are split horizontally in the area of the mounting of the rollers, and vertically between the mountings of the upper part. One advantage is that to remove a roller, removal of the respective upper end wall is sufficient.

In a preferred embodiment of the invention, the adjacent upper parts of the end walls do not touch. An advantage of this is that tilting of the end wall upper parts among each other or in contact with the side walls is prevented during removal.

In the context of this patent application, not touching means that there is a space that allows for easy removal of the upper part of the end wall. In a preferred embodiment of this invention, the parts of the end wall upper part should have no contact in order to exclude the likelihood of tilting. A distance between 0.1 cm and 5 cm should prevent tilting during removal.

Furthermore, the gap resulting from the distance between the front wall upper parts in the preferred embodiment would be sealed, with the advantage that no material and dust can exit.

In the preferred embodiment, the end wall upper portions of adjacent mountings (for example, adjacent end wall upper parts) are connected by at least one connecting element in the installed state. Particularly advantageous in the preferred embodiment is a connecting element located in a recess, so that the top faces of the end wall upper parts form a flat surface with the connection element.

In the preferred embodiment, two connecting elements of the end wall upper parts can be arranged above and below the cross member to be connected, and connected by screws. Such a connection is particularly stable.

In a simple preferred embodiment, the connecting element is a flat structure which rests on the end wall upper parts to be connected, and is screwed to these. An advantage is that the action of the frame is mechanically stabilized.

The connecting element can be formed in very different ways. Thus, it can extend over the entire width of the end wall. It is also possible for the connecting element to additionally be connected to the side walls. For this purpose, it can also be embodied as a support.

Furthermore, in the preferred embodiment, the front wall upper parts in the installed state are connected to the adjacent side wall and end wall lower parts. These connections are preferably screw connections in the preferred embodiment, as well as the connections between the connecting element and the end wall top parts. Screw connections are safe and inexpensive.

An exemplary embodiment of the invention is explained below with the help of FIGS. 1 and 2. In referring to the drawings, various reference numerals are used, as set forth in Table 1 below.

TABLE 1

List of Reference Numerals Used in the Drawings

| Reference Numeral | Description of Element |
|---|---|
| 1 | Side wall |
| 2 | End wall |
| 20 | Lower Cowl |
| 21 | Recording Storage |
| 23 | Horizontal Split |
| 24 | Vertical Split |
| 25 | Upper Cowl |
| 26 | Distance Range |
| 27 | Screwing to Lower Cowl |
| 28 | Screwing to Sidewall 1 |
| 3 | Connecting Element |
| 31 | Screw Connecting Element |

Figure 2:
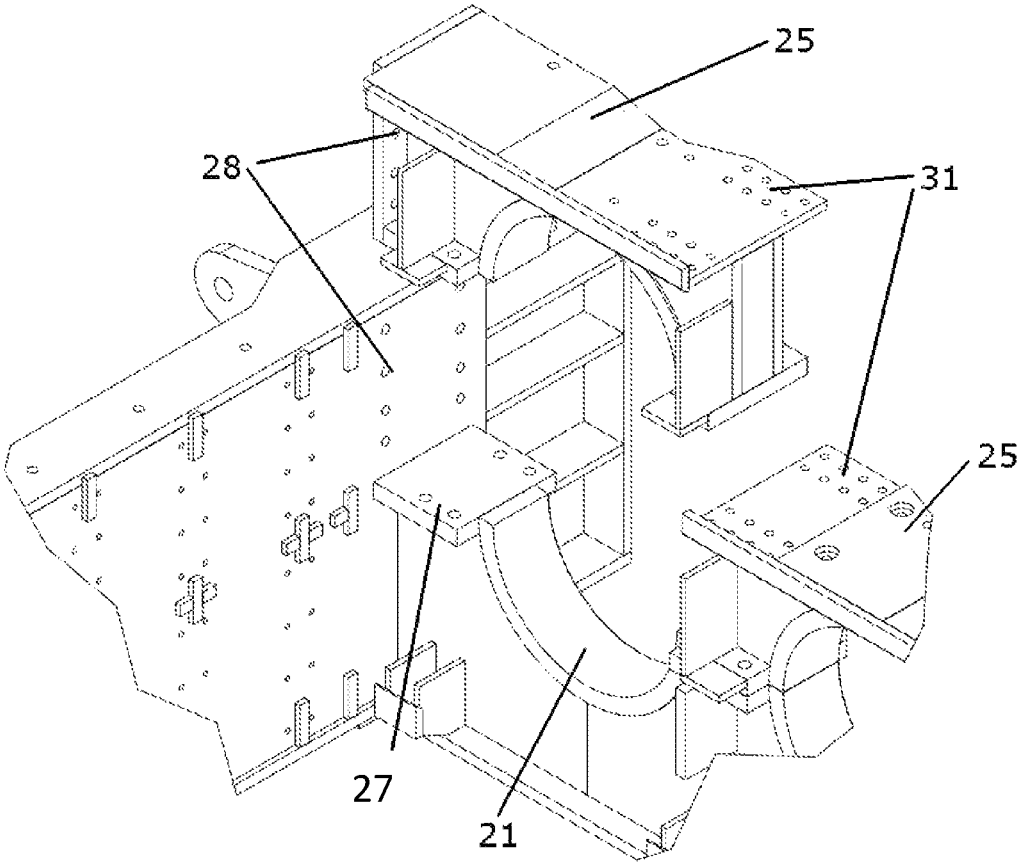
FIG. 2 is an illustration of an embodiment of one machinery frame of the present invention for a roll crusher in the open state.

FIG. 1 shows one machinery frame according to its invention for a roll crusher in the closed state, and FIG. 2 shows the machinery frame in the open state.

The closed frame as illustrated in FIG. 1 is shown having no crushing rollers. The frame has two opposite side walls 1 and two opposite end walls 2 The end walls 2 have circular receptacles 21 for the bearings of the crushing rollers. Largely in the middle of the shoot 21, the end walls 2 have a horizontal pitch 23. Between 21 both upper end walls 2 also have a vertical division 24. Thus, a side wall lower portion 20 and end wall are formed shells 25 which are individually removable for each recording 21. In the field of vertical partition 24 is the distance area 26, in is the fact that the end wall tops 25 do not touch in this area but at a distance of ca. have 1 cm. Centrally on the end walls 2 are arranged connecting elements 3 which are formed as a flat steel plate. With a variety of fittings 31 they are connected to two end wall tops 25.

FIG. 2 shows the portion of a machinery frame according to the invention with a removed upper cowl 25. There, the holes for the screw 28 of the cowl top portion 25 to the side wall 1 and for the screw 27 of the cowl top portion 25 to the end wall part 20 can be seen. The removal of the cowl upper parts 25 can advantageously without tilting.

As set forth herein, embodiments of the present invention discussed herein have been described by way of example in this specification. Having thus described the basic concept of the invention, it will be rather apparent to those of ordinary skill in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and the scope of the invention. Additionally, the recited order of processing elements or sequences, or the use of numbers, letters, or other designations therefore, is not intended to limit the claimed processes to any order, except as may be specified in the claims. Accordingly, the invention is limited only by the following claims and equivalents thereto.

What is claimed is:

1. A roller crusher comprising a machinery frame and crushing rollers removably mounted to the machinery frame, wherein said machinery frame comprises two side walls and two end walls, with said crushing rollers being removably mounted to the end walls of the machinery frame, wherein each end wall is taking up two adjacent bearings for the crushing rollers of the roller crusher, and wherein each end wall is separated as follows:

horizontally in a roller mounting area in a horizontal plane that is containing axes for the crushing rollers and dividing each end wall into a lower cowl portion and an upper cowl portion, and vertically between the adjacent bearings and between the upper cowl portion of each end wall, so that in the roller mounting area of each end wall, the upper cowl portion separates into two adjacent end wall upper parts that are releasable from the lower cowl portion and from each other.

2. A roller crusher according to claim 1, wherein the upper cowl portions of the adjacent bearings do not touch each other.

3. A roller crusher according to claim 1, wherein the adjacent end wall upper parts of each end wall are connected to each other in a sealed manner.

4. A roller crusher according to claim 1, wherein the upper cowl portions of the adjacent bearings are connected by at least one connecting element.

5. A roller crusher according to claim 4, wherein the at least one connecting element is a planar structure, which rests on the end wall to be connected to the upper cowl portions.

6. A roller crusher according to claim 1, wherein the two adjacent end wall upper parts of the upper cowl portion of each end wall are connected to their respective adjoining side wall and the lower cowl portion of each end wall.

7. A roller crusher according to claim 6, wherein a connection between a side wall lower cowl portion and end wall upper cowl portion and/or the connection between the end wall upper parts of the upper cowl portion and the adjoining side wall is by a screw connection.

* * * * *